US011674318B2

(12) United States Patent
Boo

(10) Patent No.: US 11,674,318 B2
(45) Date of Patent: Jun. 13, 2023

(54) PANEL WITH LOCKING DEVICE

(71) Applicant: Välinge Innovation AB, Viken (SE)

(72) Inventor: Christian Boo, Kagerod (SE)

(73) Assignee: VALINGE INNOVATION AB, Viken (SE)

( * ) Notice: Subject to any disclaimer, the term of this patent is extended or adjusted under 35 U.S.C. 154(b) by 0 days.

(21) Appl. No.: 17/030,923

(22) Filed: Sep. 24, 2020

(65) Prior Publication Data

US 2021/0087832 A1 Mar. 25, 2021

(30) Foreign Application Priority Data

Sep. 25, 2019 (SE) ..... 1951085-8

(51) Int. Cl.
*E04F 15/02* (2006.01)
*E04F 15/10* (2006.01)
*E04F 15/04* (2006.01)

(52) U.S. Cl.
CPC ..... *E04F 15/02038* (2013.01); *E04F 15/04* (2013.01); *E04F 15/107* (2013.01); *E04F 2201/0146* (2013.01); *E04F 2201/023* (2013.01); *E04F 2201/042* (2013.01); *E04F 2201/043* (2013.01)

(58) Field of Classification Search
CPC ..... E04F 15/02038; E04F 2201/043; E04F 2201/023
See application file for complete search history.

(56) References Cited

U.S. PATENT DOCUMENTS 6,601,359 B2 * 8/2003 Olofsson ..... E04F 13/16 52/588.1
7,051,486 B2 5/2006 Pervan
7,454,875 B2 11/2008 Pervan et al.
7,484,338 B2 * 2/2009 Pervan ..... E04F 15/02038 52/588.1
7,584,583 B2 9/2009 Bergelin et al.
(Continued)

FOREIGN PATENT DOCUMENTS

DE 102011104718 A1 * 12/2012 ..... E04F 15/02038
DE 10 2016 115 886 A1 3/2018
(Continued)

OTHER PUBLICATIONS

Machine Translation of DE-102016115886-A1 (Year: 2018).*
(Continued)

*Primary Examiner* — Michael W Hotchkiss
(74) *Attorney, Agent, or Firm* — Buchanan Ingersoll & Rooney P.C.

(57) ABSTRACT

A set of panels includes first and second panels, and a mechanical locking device for locking by vertical relative displacement of the panels. A locking strip extends from a first edge of the first panel in a direction parallel to first and second panel surfaces of the first panel. The locking strip includes a locking element configured to cooperate with a locking groove at a second edge of the second panel for locking in a direction parallel to the first panel surface. Opposite edges respectively include cooperating tongue and tongue groove for vertical locking. The locking strip includes a flexing groove extending from the second locking strip surface into the locking strip, to increase a flexibility of the locking strip during the assembly.

24 Claims, 9 Drawing Sheets

(56) References Cited

U.S. PATENT DOCUMENTS 7,634,884 B2 12/2009 Pervan
7,637,068 B2 12/2009 Pervan
7,677,005 B2 3/2010 Pervan
7,721,503 B2 5/2010 Pervan et al.
7,757,452 B2 7/2010 Pervan
7,802,411 B2 9/2010 Pervan
7,841,144 B2 11/2010 Pervan et al.
7,841,145 B2 11/2010 Pervan et al.
7,841,150 B2 11/2010 Pervan
7,861,482 B2 1/2011 Pervan et al.
7,866,110 B2 1/2011 Pervan
7,908,815 B2 3/2011 Pervan et al.
7,930,862 B2 4/2011 Bergelin et al.
7,980,041 B2 7/2011 Pervan
8,033,074 B2 10/2011 Pervan
8,042,311 B2 10/2011 Pervan
8,061,104 B2 11/2011 Pervan
8,079,196 B2 12/2011 Pervan
8,112,967 B2 2/2012 Pervan et al.
8,171,692 B2 5/2012 Pervan
8,181,416 B2 5/2012 Pervan et al.
8,234,830 B2 8/2012 Pervan et al.
8,341,914 B2 1/2013 Pervan et al.
8,341,915 B2 1/2013 Pervan et al.
8,353,140 B2 1/2013 Pervan et al.
8,359,805 B2 1/2013 Pervan et al.
8,365,499 B2 2/2013 Nilsson et al.
8,375,674 B2 * 2/2013 Braun ..... E04F 15/02 52/592.1
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,528,289 B2 9/2013 Pervan et al.
8,544,230 B2 10/2013 Pervan
8,544,234 B2 10/2013 Pervan et al.
8,572,922 B2 11/2013 Pervan
8,596,013 B2 12/2013 Boo
8,627,862 B2 1/2014 Pervan et al.
8,640,424 B2 2/2014 Pervan et al.
8,650,826 B2 2/2014 Pervan et al.
8,677,714 B2 3/2014 Pervan
8,689,512 B2 4/2014 Pervan
8,707,650 B2 4/2014 Pervan
8,713,886 B2 5/2014 Boo et al.
8,720,150 B2 * 5/2014 Hannig ..... E04F 13/0894 52/590.2
8,733,065 B2 5/2014 Pervan
8,733,410 B2 5/2014 Pervan
8,756,899 B2 6/2014 Nilsson et al.
8,763,341 B2 7/2014 Pervan
8,769,905 B2 7/2014 Pervan
8,776,473 B2 7/2014 Pervan et al.
8,806,832 B2 8/2014 Kell
8,844,236 B2 9/2014 Pervan et al.
8,857,126 B2 10/2014 Pervan et al.
8,869,485 B2 10/2014 Pervan
8,898,988 B2 12/2014 Pervan
8,925,274 B2 1/2015 Pervan et al.
8,959,866 B2 2/2015 Pervan
8,973,331 B2 3/2015 Boo
9,027,306 B2 5/2015 Pervan
9,051,738 B2 6/2015 Pervan et al.
9,068,360 B2 6/2015 Pervan
9,091,077 B2 7/2015 Boo
9,103,126 B2 8/2015 Kell
9,175,475 B2 * 11/2015 Hannig ..... C10L 11/06
9,194,134 B2 11/2015 Nygren et al.
9,212,492 B2 12/2015 Pervan et al.
9,216,541 B2 12/2015 Boo et al.
9,238,917 B2 1/2016 Pervan et al.
9,249,581 B2 2/2016 Nilsson et al.
9,284,737 B2 3/2016 Pervan et al.
9,309,679 B2 4/2016 Pervan et al.
9,316,002 B2 4/2016 Boo
9,340,974 B2 5/2016 Pervan et al.
9,347,469 B2 5/2016 Pervan
9,359,774 B2 6/2016 Pervan
9,366,036 B2 6/2016 Pervan
9,376,821 B2 6/2016 Pervan
9,382,716 B2 7/2016 Pervan et al.
9,388,584 B2 7/2016 Pervan et al.
9,428,919 B2 8/2016 Pervan et al.
9,453,347 B2 9/2016 Pervan
9,458,634 B2 10/2016 Derelov
9,482,012 B2 11/2016 Nygren et al.
9,540,826 B2 1/2017 Pervan et al.
9,663,940 B2 5/2017 Boo
9,725,912 B2 8/2017 Pervan
9,771,723 B2 9/2017 Pervan
9,777,487 B2 10/2017 Pervan et al.
9,803,374 B2 10/2017 Pervan
9,803,375 B2 10/2017 Pervan
9,856,656 B2 1/2018 Pervan
9,874,027 B2 1/2018 Pervan
9,945,130 B2 4/2018 Nygren et al.
9,951,526 B2 4/2018 Boo et al.
10,000,935 B2 6/2018 Kell
10,006,210 B2 6/2018 Pervan et al.
10,017,948 B2 7/2018 Boo
10,047,527 B2 8/2018 Nilsson et al.
10,113,319 B2 10/2018 Pervan
10,125,488 B2 11/2018 Boo
10,138,636 B2 11/2018 Pervan
10,161,139 B2 12/2018 Pervan
10,180,005 B2 1/2019 Pervan et al.
10,214,915 B2 2/2019 Pervan et al.
10,214,917 B2 2/2019 Pervan et al.
10,240,348 B2 3/2019 Pervan et al.
10,240,349 B2 3/2019 Pervan et al.
10,246,883 B2 4/2019 Derelöv
10,352,049 B2 7/2019 Boo
10,358,830 B2 7/2019 Pervan
10,378,217 B2 8/2019 Pervan
10,458,125 B2 10/2019 Pervan
10,480,196 B2 11/2019 Boo
10,519,676 B2 12/2019 Pervan
10,526,792 B2 1/2020 Pervan et al.
10,526,793 B2 1/2020 Nilsson et al.
10,538,922 B2 1/2020 Pervan
10,570,625 B2 2/2020 Pervan
10,640,989 B2 5/2020 Pervan
10,655,339 B2 5/2020 Pervan
10,669,723 B2 6/2020 Pervan et al.
10,724,251 B2 7/2020 Kell
10,731,358 B2 8/2020 Pervan
10,738,477 B2 * 8/2020 Hannig ..... E04F 15/02038
10,794,065 B2 10/2020 Boo
10,828,798 B2 11/2020 Fransson
10,933,592 B2 3/2021 Blomgren et al.
10,934,721 B2 3/2021 Pervan et al.
10,953,566 B2 3/2021 Fransson et al.
10,968,639 B2 4/2021 Pervan et al.
10,975,577 B2 4/2021 Pervan et al.
10,995,501 B2 5/2021 Pervan
11,002,021 B2 * 5/2021 Cappelle ..... E04F 15/02038
11,045,933 B2 6/2021 Fransson et al.
11,053,691 B2 7/2021 Pervan
11,053,692 B2 7/2021 Pervan
11,060,302 B2 7/2021 Ylikangas et al.
11,066,835 B2 7/2021 Boo
11,242,687 B2 * 2/2022 Boucké ..... E04F 15/02038
2002/0007608 A1 * 1/2002 Pervan ..... E04F 15/02 52/578
2003/0084636 A1 * 5/2003 Pervan ..... E04F 15/04 52/592.1
2004/0016196 A1 1/2004 Pervan
2005/0160694 A1 7/2005 Pervan
2005/0021081 A1 9/2005 Pervan
2006/0070333 A1 4/2006 Pervan
2006/0101769 A1 5/2006 Pervan
2006/0196139 A1 * 9/2006 Pervan ..... E04C 2/20 52/586.1

(56) References Cited

U.S. PATENT DOCUMENTS

2006/0236642 A1 10/2006 Pervan
2006/0260254 A1 11/2006 Pervan et al.
2008/0000186 A1 1/2008 Pervan et al.
2008/0000187 A1 1/2008 Pervan et al.
2008/0010931 A1 1/2008 Pervan et al.
2008/0010937 A1 1/2008 Pervan et al.
2008/0028707 A1 2/2008 Pervan
2008/0034708 A1 2/2008 Pervan
2008/0041008 A1 2/2008 Pervan
2008/0066415 A1 3/2008 Pervan
2008/0104921 A1 5/2008 Pervan et al.
2008/0110125 A1 5/2008 Pervan
2008/0134607 A1 6/2008 Pervan
2008/0134613 A1 6/2008 Pervan
2008/0134614 A1 6/2008 Pervan
2008/0155930 A1 7/2008 Pervan et al.
2008/0216434 A1 9/2008 Pervan
2008/0216920 A1 9/2008 Pervan
2008/0295432 A1 12/2008 Pervan et al.
2009/0133353 A1* 5/2009 Pervan ..... E04F 15/107 52/588.1
2009/0151290 A1* 6/2009 Liu ..... E04F 15/04 52/586.1
2009/0193748 A1 8/2009 Boo et al.
2010/0218450 A1 9/2010 Braun et al.
2010/0293879 A1 11/2010 Pervan et al.
2010/0300031 A1 12/2010 Pervan et al.
2010/0319290 A1 12/2010 Pervan
2010/0319291 A1 12/2010 Pervan et al.
2011/0030303 A1 2/2011 Pervan et al.
2011/0041996 A1 2/2011 Pervan
2011/0056167 A1 3/2011 Nilsson et al.
2011/0088344 A1 4/2011 Pervan et al.
2011/0088345 A1 4/2011 Pervan
2011/0154763 A1 6/2011 Bergelin et al.
2011/0167750 A1 7/2011 Pervan
2011/0225922 A1 9/2011 Pervan et al.
2011/0252733 A1 10/2011 Pervan
2011/0283650 A1 11/2011 Pervan et al.
2012/0017533 A1 1/2012 Pervan et al.
2012/0031029 A1 2/2012 Pervan et al.
2012/0036804 A1 2/2012 Pervan
2012/0151865 A1 6/2012 Pervan et al.
2012/0174515 A1 7/2012 Pervan
2012/0174520 A1 7/2012 Pervan
2012/0279161 A1 11/2012 Hakansson et al.
2013/0008117 A1 1/2013 Pervan
2013/0014463 A1 1/2013 Pervan
2013/0019555 A1 1/2013 Pervan
2013/0036695 A1* 2/2013 Durnberger ..... E04F 15/02038 52/309.3
2013/0042562 A1 2/2013 Pervan
2013/0042563 A1 2/2013 Pervan
2013/0042564 A1 2/2013 Pervan et al.
2013/0042565 A1 2/2013 Pervan
2013/0047536 A1 2/2013 Pervan
2013/0081349 A1 4/2013 Pervan et al.
2013/0111758 A1 5/2013 Nilsson et al.
2013/0111845 A1 5/2013 Pervan
2013/0145708 A1 6/2013 Pervan
2013/0160391 A1 6/2013 Pervan et al.
2013/0232905 A2 9/2013 Pervan
2013/0239508 A1 9/2013 Pervan et al.
2013/0263454 A1 10/2013 Boo et al.
2013/0263547 A1* 10/2013 Boo ..... E04B 1/54 52/588.1
2013/0309441 A1* 11/2013 Hannig ..... E04F 15/102 29/428
2013/0318906 A1 12/2013 Pervan et al.
2014/0007539 A1 1/2014 Pervan et al.
2014/0020324 A1 1/2014 Pervan
2014/0033633 A1 2/2014 Kell
2014/0033634 A1 2/2014 Pervan
2014/0053497 A1 2/2014 Pervan et al.
2014/0059966 A1 3/2014 Boo
2014/0069043 A1 3/2014 Pervan
2014/0090335 A1 4/2014 Pervan et al.
2014/0109501 A1 4/2014 Pervan
2014/0109506 A1 4/2014 Pervan et al.
2014/0123586 A1 5/2014 Pervan et al.
2014/0190112 A1 7/2014 Pervan
2014/0208677 A1 7/2014 Pervan et al.
2014/0223852 A1 8/2014 Pervan
2014/0237924 A1 8/2014 Nilsson et al.
2014/0237931 A1 8/2014 Pervan
2014/0250813 A1 9/2014 Nygren et al.
2014/0260060 A1 9/2014 Pervan et al.
2014/0305065 A1 10/2014 Pervan
2014/0366476 A1 12/2014 Pervan
2014/0366477 A1 12/2014 Kell
2014/0373478 A2 12/2014 Pervan et al.
2014/0373480 A1 12/2014 Pervan et al.
2015/0000221 A1 1/2015 Boo
2015/0013260 A1 1/2015 Pervan
2015/0059281 A1 3/2015 Pervan
2015/0089896 A2 4/2015 Pervan et al.
2015/0121796 A1 5/2015 Pervan
2015/0152644 A1 6/2015 Boo
2015/0167318 A1 6/2015 Pervan
2015/0211239 A1 7/2015 Pervan
2015/0233125 A1 8/2015 Pervan et al.
2015/0267418 A1* 9/2015 Vermeulen ..... E04F 15/02038 52/582.2
2015/0267419 A1 9/2015 Pervan
2015/0300029 A1 10/2015 Pervan
2015/0330088 A1 11/2015 Derelov
2015/0337537 A1 11/2015 Boo
2015/0368910 A1 12/2015 Kell
2016/0032596 A1 2/2016 Nygren et al.
2016/0060879 A1 3/2016 Pervan
2016/0069088 A1 3/2016 Boo et al.
2016/0076260 A1 3/2016 Pervan et al.
2016/0090744 A1 3/2016 Pervan et al.
2016/0108624 A1 4/2016 Nilsson et al.
2016/0153200 A1 6/2016 Pervan
2016/0168866 A1 6/2016 Pervan et al.
2016/0186426 A1 6/2016 Boo
2016/0194884 A1 7/2016 Pervan et al.
2016/0201336 A1 7/2016 Pervan
2016/0251859 A1 9/2016 Pervan et al.
2016/0251860 A1 9/2016 Pervan
2016/0281368 A1 9/2016 Pervan et al.
2016/0281370 A1 9/2016 Pervan et al.
2016/0326751 A1 11/2016 Pervan
2016/0340913 A1 11/2016 Derelöv
2017/0037641 A1 2/2017 Nygren et al.
2017/0081860 A1 3/2017 Boo
2017/0254096 A1 9/2017 Pervan
2017/0268238 A1* 9/2017 Pervan ..... E04F 15/18
2017/0321433 A1 11/2017 Pervan et al.
2017/0350139 A1* 12/2017 De Rick ..... E04F 13/0889
2017/0362834 A1 12/2017 Pervan et al.
2018/0000151 A1 1/2018 Fransson
2018/0001509 A1 1/2018 Myllykangas et al.
2018/0001573 A1 1/2018 Blomgren et al.
2018/0002933 A1 1/2018 Pervan
2018/0016783 A1 1/2018 Boo
2018/0030737 A1 2/2018 Pervan
2018/0030738 A1 2/2018 Pervan
2018/0094441 A1 4/2018 Boo
2018/0119431 A1 5/2018 Pervan et al.
2018/0178406 A1 6/2018 Fransson et al.
2018/0313093 A1 11/2018 Nilsson et al.
2019/0024387 A1 1/2019 Pervan
2019/0048592 A1 2/2019 Boo
2019/0048596 A1 2/2019 Pervan
2019/0063076 A1 2/2019 Boo et al.
2019/0093370 A1 3/2019 Pervan et al.
2019/0093371 A1 3/2019 Pervan
2019/0119928 A1 4/2019 Pervan et al.
2019/0127989 A1 5/2019 Kell
2019/0127990 A1 5/2019 Pervan et al.
2019/0169859 A1 6/2019 Pervan et al.

(56) References Cited

U.S. PATENT DOCUMENTS

| | | | | |
|---|---|---|---|---|
| 2019/0232473 | A1 | 8/2019 | Fransson et al. | |
| 2019/0271165 | A1 | 9/2019 | Boo | |
| 2019/0376298 | A1 | 12/2019 | Pervan et al. | |
| 2019/0394314 | A1 | 12/2019 | Pervan et al. | |
| 2020/0087927 | A1 | 3/2020 | Pervan | |
| 2020/0102756 | A1 | 4/2020 | Pervan | |
| 2020/0109569 | A1 | 4/2020 | Pervan | |
| 2020/0149289 | A1 | 5/2020 | Pervan | |
| 2020/0173175 | A1 | 6/2020 | Pervan | |
| 2020/0190824 | A1* | 6/2020 | De Rick | E04F 15/105 |
| 2020/0224430 | A1 | 7/2020 | Ylikangas et al. | |
| 2020/0232226 | A1* | 7/2020 | De Rick | E04F 15/102 |
| 2020/0263437 | A1 | 8/2020 | Pervan | |
| 2020/0284045 | A1 | 9/2020 | Kell | |
| 2020/0308846 | A1* | 10/2020 | Josefsson | E04F 15/02033 |
| 2020/0318667 | A1 | 10/2020 | Derelőv | |
| 2020/0340254 | A1* | 10/2020 | De Rick | E04F 15/02038 |
| 2020/0354969 | A1 | 11/2020 | Pervan et al. | |
| 2020/0362567 | A1 | 11/2020 | Nilsson et al. | |
| 2020/0412852 | A9 | 12/2020 | Pervan et al. | |
| 2021/0016465 | A1 | 1/2021 | Fransson | |
| 2021/0047840 | A1 | 2/2021 | Pervan | |
| 2021/0047841 | A1 | 2/2021 | Pervan et al. | |
| 2021/0054631 | A1 | 2/2021 | Bladh | |
| 2021/0071428 | A1 | 3/2021 | Pervan | |
| 2021/0087831 | A1 | 3/2021 | Nilsson et al. | |
| 2021/0087833 | A1 | 3/2021 | Ylikangas et al. | |
| 2021/0087834 | A1 | 3/2021 | Ylikangas et al. | |

FOREIGN PATENT DOCUMENTS

| | | | | |
|---|---|---|---|---|
| DE | 102016115886 | A1 * | 3/2018 | E04F 15/105 |
| WO | WO 2018/063047 | A1 | 4/2018 | |
| WO | WO 2019/170605 | A1 | 9/2019 | |
| WO | WO-2020083613 | A1 * | 4/2020 | E04F 15/105 |
| WO | WO-2020083615 | A1 * | 4/2020 | E04F 15/105 |

OTHER PUBLICATIONS

Machine Translation of DE-102011104718-A1 (Year: 2012).*

16/253,465, Darko Pervan and Marcus Nilsson Ståhl, filed Jan. 22, 2019 (Cited herein as US Patent Application Publication No. 2019/0394314 A1 of Dec. 26, 2019 and as Republication No. US 2020/0412852 A9 of Dec. 31, 2020).

U.S. Appl. No. 16/708,719, Darko Pervan, filed Dec. 10, 2019 (Cited herein as US Patent Application Publication No. 2020/0109569 A1 of Apr. 9, 2020).

U.S. Appl. No. 16/745,613, Darko Pervan, filed Jan. 17, 2020 (Cited herein as US Patent Application Publication No. 2020/0149289 A1 of May 14, 2020).

U.S. Appl. No. 16/881,129, Richard William Kell, filed May 22, 2020 (Cited herein as US Patent Application Publication No. 2020/0284045 A1 of Sep. 10, 2020).

U.S. Appl. No. 17/029,658, Anders Nilsson, Karl Quist, Roger Ylikangas and Frederik Boo, filed Sep. 23, 2020 (Cited herein as US Patent Application Publication No. 2021/0087831 A1 of Mar. 25, 2021).

U.S. Appl. No. 17/030,966, Roger Ylikangas and Thomas Meijer, filed Sep. 24, 2020 (Cited herein as US Patent Application Publication No. 2021/0087833 A1 of Mar. 25, 2021).

U.S. Appl. No. 17/031,166, Roger Ylikangas, Thomas Meijer and Anders Nilsson, filed Sep. 24, 2020 (Cited herein as US Patent Application Publication No. 2021/0087834 A1 of Mar. 25, 2021).

U.S. Appl. No. 17/368,075, Richard William Kell, filed Jul. 21, 2021.

International Search Report and Written Opinion dated Nov. 3, 2020 in PCT/IB2020/058925, ISA/SE Patent-och registreringsverket, Stockholm, SE, 9 pages.

Kell, Richard William, U.S. Appl. No. 17/368,075 entitled "Vertical Joint System an Associated Surface Covering System," filed in the U.S. Patent and Trademark Office filed Jul. 6, 2021.

* cited by examiner

PANEL WITH LOCKING DEVICE

CROSS REFERENCE TO RELATED APPLICATIONS

The present application claims the benefit of Swedish Application No. 1951085-8, filed on Sep. 25, 2019. The entire contents of Swedish Application No. 1951085-8 are hereby incorporated herein by reference in their entirety.

TECHNICAL FIELD

Embodiments of the present disclosure relate to panels configured to be locked together with a mechanical locking device. The panels may be floorboards to be locked together to obtain a floor product.

TECHNICAL BACKGROUND

Panels are known that are configured to be assembled by a vertical displacement and to be locked together in a vertical direction and in a horizontal direction. Such panels are disclosed in e.g., WO 2018/063047. A tongue and groove connection locks a first edge of a first panel to a second edge of the second panel. The first edge and the second edge furthermore comprise a locking element configured to cooperate with a locking groove for locking in the vertical direction and the horizontal direction.

The above description of various known aspects is the applicant's characterization of such, and is not an admission that any of the above description is considered as prior art.

Embodiments of the present disclosure address a need to provide panels that can be easily assembled.

SUMMARY

It is an object of certain aspects of the present disclosure to provide an improvement over the above described techniques and known art.

A further object of at least certain aspects of the present disclosure is to facilitate the assembling of panels configured to be assembled by a vertical displacement or an angling motion and locked together in the vertical direction and the horizontal direction.

A further object of at least certain aspects of the present disclosure is to facilitate assembling of panels configured to be assembled in a way that reduces a force and impact needed from a person when assembling the panels.

According to a first aspect there is provided a set of panels comprising a first panel, a second panel and a mechanical locking device for locking the first panel to the second panel, the mechanical locking device being configured for an assembly by a displacement of the second panel in relation to the first panel in a vertical direction to obtain a locked position of the first panel and the second panel, wherein the first panel comprises a first edge, a first panel surface and a second panel surface, and the second panel comprises a second edge, wherein the mechanical locking device comprises a locking strip extending from the first edge in a direction parallel to the first and second panel surfaces, wherein the locking strip comprises a locking strip edge, wherein the locking strip comprises a first locking strip surface extending in a direction substantially corresponding to the direction of the first panel surface of the first panel, wherein the locking strip comprises a second locking strip surface extending in a direction substantially corresponding to the direction of the second panel surface of the first panel, wherein the locking strip comprises a locking element configured to cooperate with a locking groove at the second edge of the second panel for locking in a direction parallel to the first panel surface, wherein one of the first or second edge comprises a tongue configured to cooperate with a tongue groove at the other one of the first or second edge for locking in a vertical direction, wherein the locking strip comprises a flexing groove extending from the second locking strip surface into the locking strip, and that the locking strip is configured to flex by varying a shape of the flexing groove during the assembly, thereby increasing a flexibility of the locking strip during the assembly.

According to an aspect the second locking strip surface comprises a recess extending from the locking strip edge to the flexing groove and parallel to the second panel surface.

According to an aspect the recess has a length B and the locking strip edge is positioned at a distance Q from the first edge.

According to an aspect, the distance Q is measured between the outer edge of the locking strip edge and the intersection between the first edge and the first panel surface.

According to an aspect a ratio between the length B of the recess and the distance Q is within the range of about 0.1 to about 0.9, preferably about 0.2 to about 0.6, more preferably about 0.35.

According to an aspect the recess has a height A within the range of 0.10 mm to about 0.50 mm, preferably about 0.15 mm to about 0.40 mm, more preferably about 0.20 mm to about 0.30 mm.

According to an aspect an opening of the flexing groove has a width T.

According to an aspect the width T of the opening of the flexing groove is within the range of about 1 mm to about 10 mm, preferably about 1.2 mm to about 2.5 mm, more preferably about 1.5 mm.

According to an aspect a distance D between the bottom of the flexing groove and the first locking strip surface is within the range of about 0.5 mm to about 5 mm, preferably about 1 mm to about 2.5 mm, more preferably about 1.5 mm.

According to an aspect the flexing groove extends at an angle $\alpha$ from the second panel surface.

According to an aspect the angle $\alpha$ is within the range of about 30° to about 100°, preferably about 60° to about 80°, more preferably about 70°.

According to an aspect the flexing groove is positioned at a distance Z from the locking strip edge of the locking strip.

According to an aspect a ratio between the distance Z and the distance Q is within the range of about 0 to about 0.5, preferably about 0.1 to about 0.3.

According to an aspect the flexing groove has a length L.

According to an aspect the first panel comprises a third edge and a fourth edge, the third edge being at a distance TL from the fourth edge.

According to an aspect the length L of the flexing groove extends from the third edge of the first panel to the fourth edge of the first panel.

According to an aspect the flexing groove has a fifth edge and a sixth edge, the fifth edge being positioned at a distance X from the third edge and the sixth edge being positioned at a distance X from the fourth edge.

According to an aspect the distance X is within the range of about 5 mm to about 30 mm, preferably about 10 mm to about 20 mm, more preferably about 15 mm.

According to an aspect a bottom of the flexing groove is essentially arch shaped.

According to an aspect a bottom of the flexing groove is essentially triangular.

According to an aspect a cross-sectional shape of the flexing groove is essentially rectangular or square.

According to an aspect the mechanical locking device is configured to lock the first panel and the second panel in a first direction parallel to the first panel surface and/or in a second direction perpendicular to the first panel surface.

According to an aspect the flexing groove is positioned at a distance Y from the first edge.

According to an aspect a ratio between the distance Y and the distance Q is within the range of about 0 to about 0.5, preferably about 0.1 to about 0.3.

According to an aspect a distance between the flexing groove and the locking element is shorter than a distance between the flexing groove and the first edge.

According to an aspect the second locking strip comprises a material of a core of the first panel.

According to an aspect the flexing groove and the recess are formed in the material of the core of the first panel.

According to an aspect the mechanical locking device is partly or completely formed in a core material of the first panel and the second panel.

According to an aspect the core of the first panel and/or of the second panel may be a wood-based core, preferably made of MDF, HDF, OSB, WPC, plywood or particleboard. The core may also be a plastic core comprising thermosetting plastic or thermoplastic e.g., vinyl, PVC, PU or PET. The plastic core may comprise fillers. The core may also be mineral based board which may comprise e.g., MgO.

The first panel and/or the second panel may also be of solid wood.

The first panel and/or the second panel may be provided with a decorative layer, such as a foil or a veneer, on one or more surfaces.

BRIEF DESCRIPTION OF THE DRAWINGS

These and other aspects, features and advantages of which embodiments of the disclosure are capable of, will be apparent and elucidated from the following description of embodiments and aspects of the present disclosure, reference being made to the accompanying drawings.

DETAILED DESCRIPTION

Figure 1A:
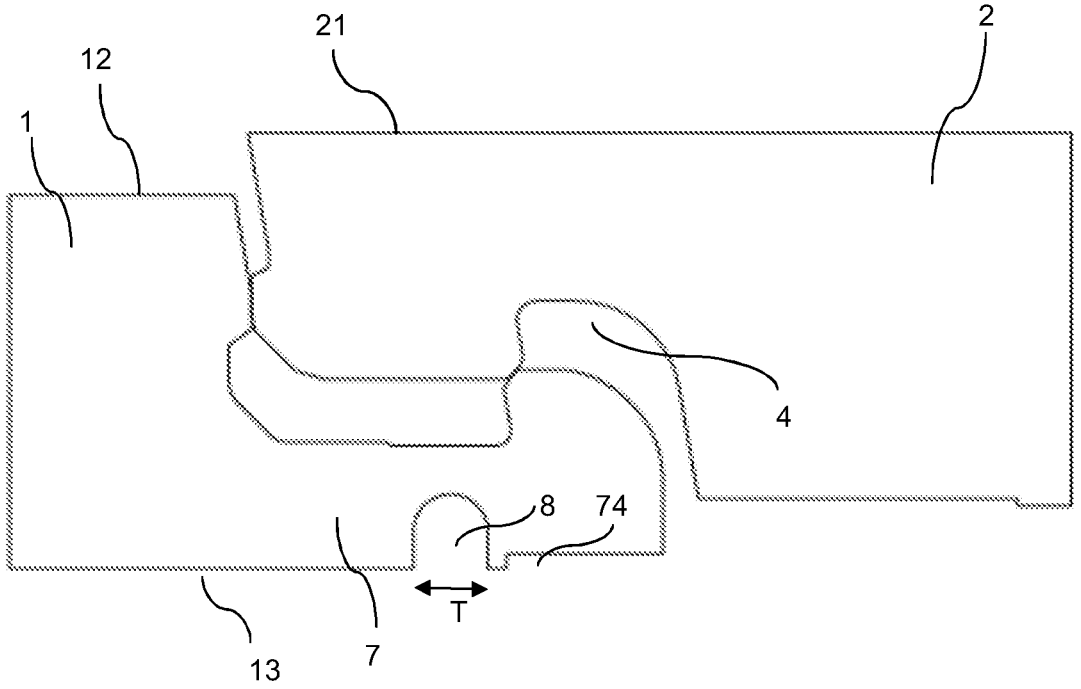
FIG. 1A shows a side view of an illustrative set in an unassembled state.
Figure 1B:
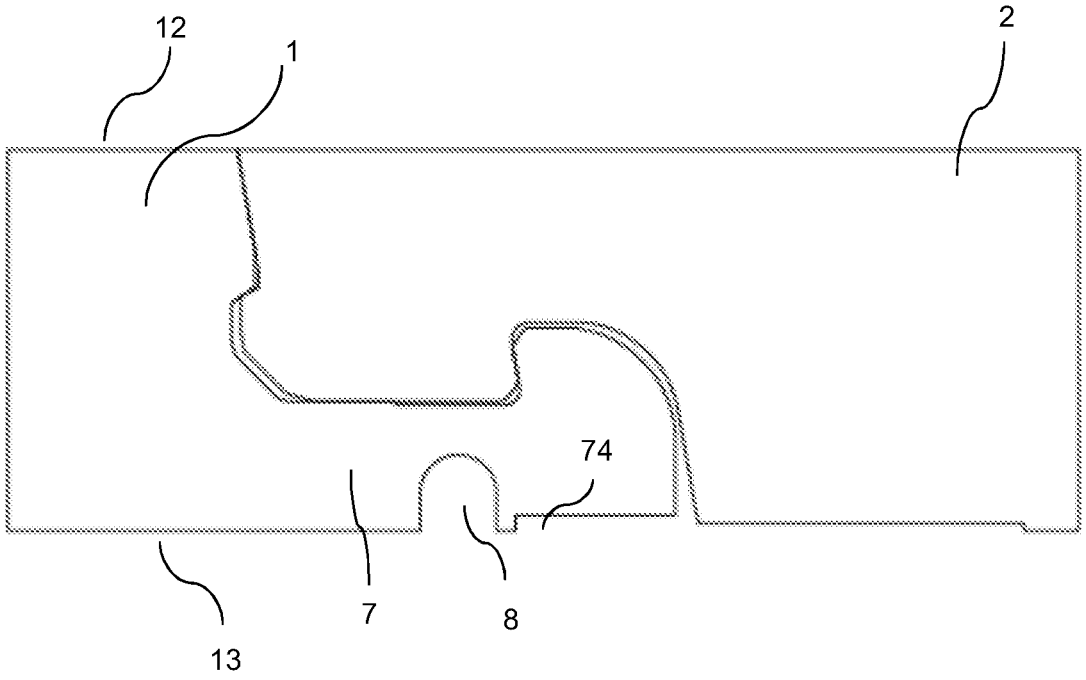
FIG. 1B shows a side view of an illustrative set in an assembled state.

Specific embodiments of the disclosure will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the disclosure. In the drawings, like numbers refer to like elements.

The terminology used herein is for the purpose of describing particular aspects of the disclosure only, and is not intended to limit the disclosure. As used herein, the singular forms "a", "an" and "the" are intended to include the plural forms as well, unless the context clearly indicates otherwise.

It should be noted that the word "comprising" does not necessarily exclude the presence of other elements or steps than those listed and the words "a" or "an" preceding an element do not exclude the presence of a plurality of such elements. It should further be noted that any reference signs do not limit the scope of the claims, that the example aspects may be implemented at least in part by means of both hardware and software, and that several "means", "units" or "devices" may be represented by the same item of hardware.

The different aspects, alternatives and embodiments of the disclosure disclosed herein can be combined with one or more of the other aspects, alternatives and embodiments described herein. Two or more aspects can be combined.

A first embodiment of the disclosure is shown, e.g., in FIGS. 1A-1B and 4A-5B, which show illustrative sets of panels comprising a first panel 1, a second panel 2 and a mechanical locking device for locking the first panel 1 to the second panel 2. The mechanical locking device is configured for an assembly by a displacement of the second panel 2 in relation to the first panel 1 in a vertical direction to obtain a locked position of the first panel 1 and the second panel 2. The first panel 1 comprises a first edge 11, a first panel surface 12 and a second panel surface 13. The second panel 2 comprises a second edge 21. The mechanical locking device comprises a locking strip 7 extending from the first edge 11 in a direction parallel to the first and second panel surfaces 12, 13, wherein the locking strip 7 comprises a locking strip edge 71, wherein the locking strip 7 comprises a first locking strip surface 72 extending in a direction substantially corresponding to the direction of the first panel surface 12 of the first panel 1, wherein the locking strip 7 comprises a second locking strip surface 73 extending in a direction substantially corresponding to the direction of the second panel surface 13 of the first panel 1, and wherein the locking strip 7 comprises a locking element 3 configured to cooperate with a locking groove 4 at the second edge 21 of the second panel 2 for locking in a direction parallel to the first panel surface 12. By "substantially corresponding" it is meant that the noted directions may form an angle within a range of +/−10 degrees. One of the first or second edge 11, 21 comprises a tongue 5 configured to cooperate with a tongue groove 6 at the other one of the first or second edge 11, 21 for locking in a vertical direction. The set is characterized in that the locking strip 7 comprises a flexing groove 8 extending from the second locking strip surface 73 into the locking strip 7, and that the locking strip 7 is configured to flex by varying a shape of the flexing groove 8 during the assembly, thereby increasing a flexibility of the locking strip 7 during the assembly.

The increased flexibility of the locking strip 7 during assembly results in an increased distance between the first edge 11 and the locking element 3. This results in an easier assembly of the first 1 and second 2 panels.

In one embodiment, the locking strip 7 may comprise two or more flexing grooves 8 running parallel to each other.

The first panel 1 and the second panel 2 are preferably floorboards configured to be locked together to obtain a floor product.

An embodiment of a first panel 1 is shown in FIGS. 1A-1B and 3A-3B, where the second locking strip surface 73 comprises a recess 74 which extends from the locking strip edge 71 towards the flexing groove 8 and parallel to the second panel surface 13. This increases the flexing of the locking strip 7 during assembly of the first and second panels 1, 2 and makes the assembly easier. The recess 74 may have a length B.

The locking strip edge 71 may be positioned at a distance Q from the first edge 11 of the first panel 1.

According to an aspect, the distance Q is to be measured between the outer edge of the locking strip edge 71 and the intersection between the first edge 11 and the first panel surface 12.

The ratio between the length B of the recess 74 and the distance Q may be within the range of about 0.1 to about 0.9, preferably about 0.2 to about 0.6, more preferably about 0.35. The ratios are great enough to allow an easy assembling and small enough to allow a sufficient locking strength. A ratio of 0.9 may provide an easier assembling and a ratio of 0.1 may provide a higher locking strength. The preferred ratio can depend on e.g. the material of the locking strip.

The recess 74 may have a height A within the range of 0.10 mm to about 0.50 mm, preferably about 0.15 mm to about 0.40 mm, more preferably about 0.20 mm to about 0.30 mm. The values are high enough to allow an easy assembling and low enough to allow a sufficient locking strength. A height A of 0.5 mm may provide an easier assembling and a height A of 0.1 mm may provide a higher locking strength. The preferred value can depend on e.g. the material of the locking strip.

Figure 2A:
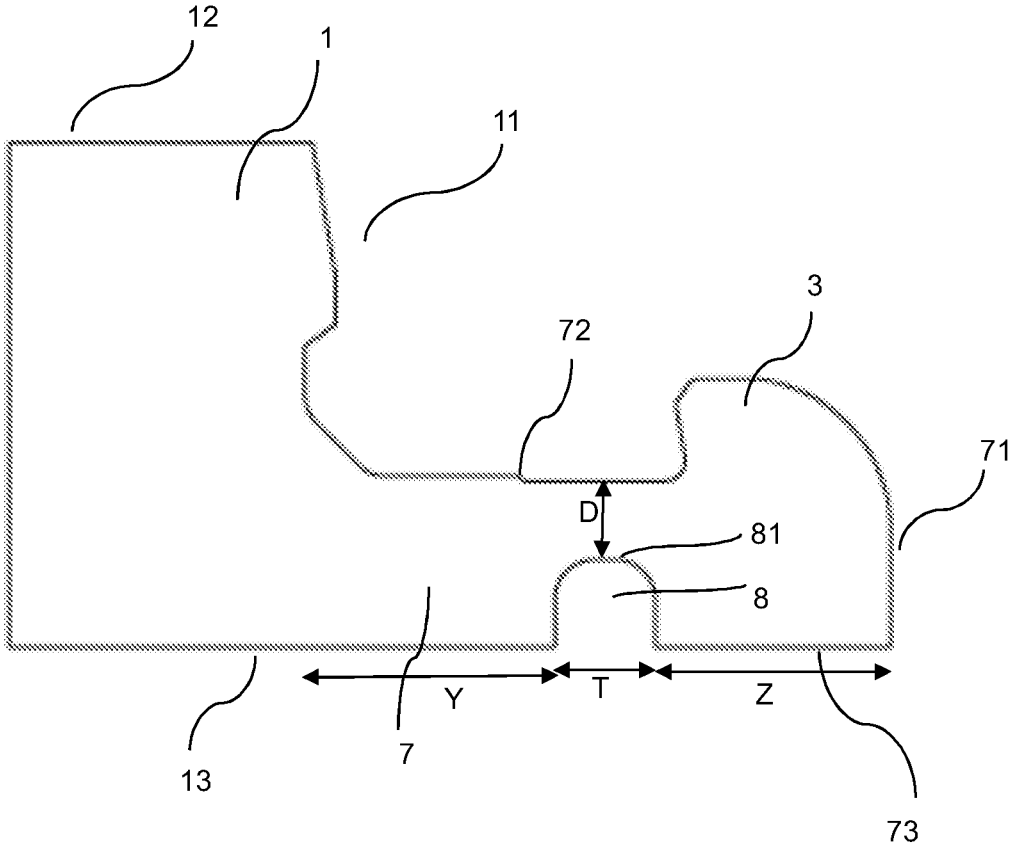
FIG. 2A shows a side view of an illustrative first panel comprising a locking strip and a flexing groove.
Figure 2B:
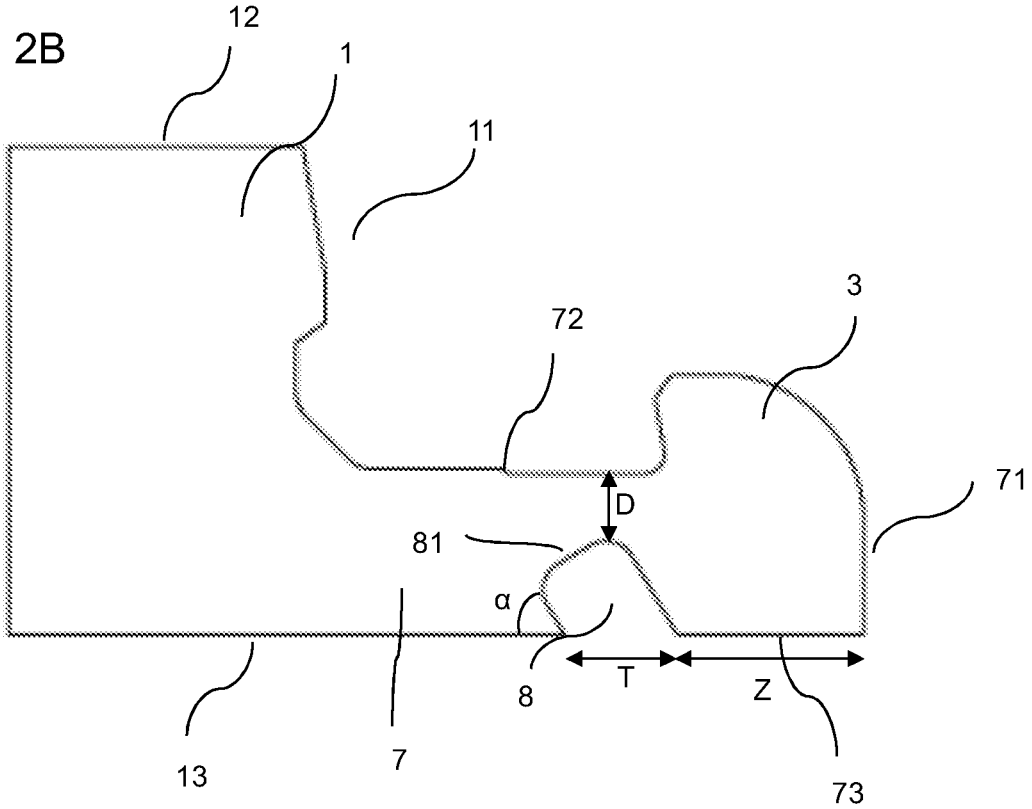
FIG. 2B shows a side view of an illustrative first panel comprising a locking strip and a flexing groove.
Figure 3A:
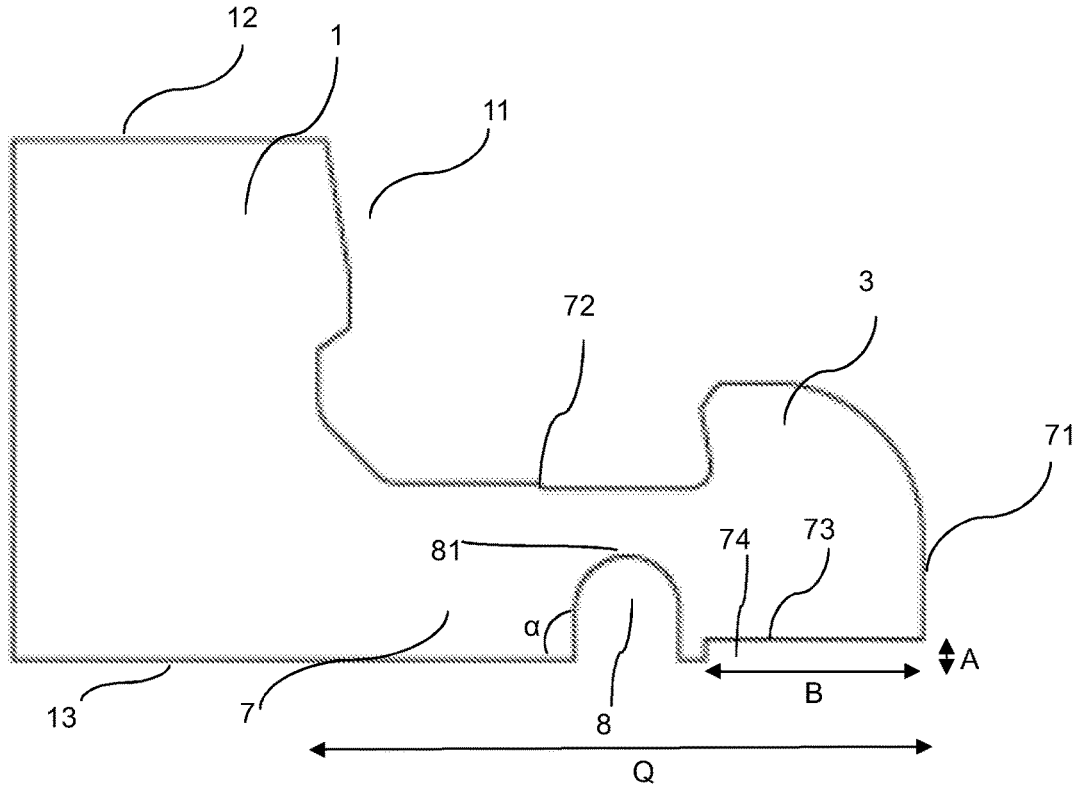
FIG. 3A shows a side view of an illustrative first panel, which comprises a locking strip and a flexing groove, and wherein the locking strip comprises a recess parallel to the second panel surface.
Figure 3B:
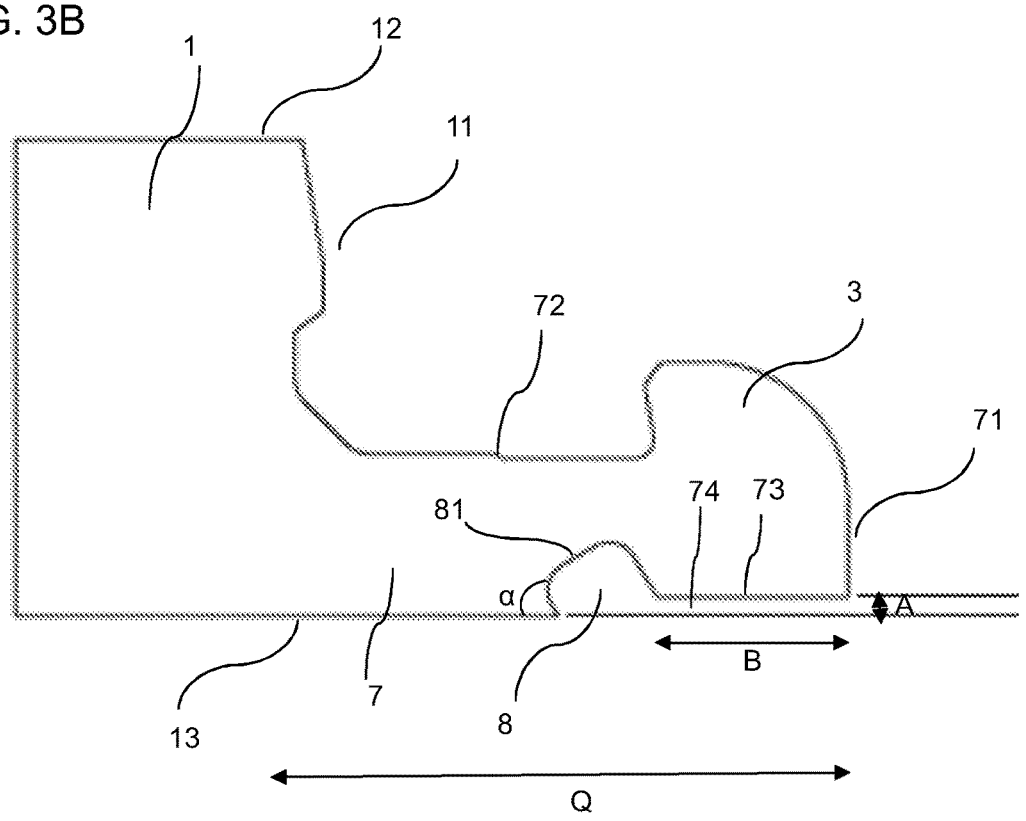
FIG. 3B shows a side view of an illustrative first panel, which comprises a locking strip and a flexing groove, and wherein the locking strip comprises a recess parallel to the second panel surface.

As shown for example in FIGS. 2A-2B, illustrative flexing grooves 8 in the first panel 1 are shown in FIGS. 1A-9. In one aspect the opening of the flexing groove 8 has a width T. In one aspect the width T of the opening of the flexing groove 8 is within the range of about 1 mm to about 10 mm, preferably about 1.2 mm to about 2.5 mm, more preferably about 1.5 mm.

The values are high enough to allow an easy assembling and low enough to allow a sufficient locking strength. A width T of 2.5 mm may provide an easier assembling and width T of 1 mm may provide a higher locking strength. The preferred value can depend on e.g. the material of the locking strip.

The bottom 81 of the flexing groove 8 and the first locking strip surface 72 may be positioned at a distance D from each other. The distance D may be within the range of about 0.5 mm to about 5 mm, preferably about 1 mm to about 2.5 mm, more preferably about 1.5 mm. The values are low enough to allow an easy assembling and high enough to allow a sufficient locking strength. A distance D of 1 mm may provide an easier assembling and distance D of 2.5 mm may provide a higher locking strength. The preferred value can depend on e.g. the material of the locking strip.

In one aspect, if the thickness of the first panel 1, i.e., the distance between the first panel surface 12 and the second panel surface 13, is changed during production, e.g., from production of panels with a thickness of 8 mm to panels with a thickness of 12 mm, the distance D will still remain the same, and the tools required for the production will not have to be adjusted.

As shown for example in FIG. 2B, the flexing groove 8 may extend at an angle $\alpha$ from the second panel surface 13. The angle $\alpha$ is selected to optimize the flexing during assembly so that the assembly of the first and second panels 1, 2 is easily facilitated. For example, one or several inner surface(s) of the flexing groove 8 may extend at the angle $\alpha$ from the second panel surface 13.

In one aspect the angle $\alpha$ is within the range of about 30° to about 100°, preferably about 60° to about 80°, more preferably about 70°.

It shall be understood that the term "about" includes a margin for a measurement error which may be between 1° and 3°.

The flexing groove 8 may be positioned at a distance Z from the locking strip edge 71 of the locking strip 7.

A ratio between the distance Z and the distance Q may be within the range of about 0 to about 0.5, preferably about 0.1 to about 0.3. The values are high enough to allow enable an easy assembling and low enough to allow a sufficient locking strength. A ratio of 0.5 may provide an easier assembling and a ratio of 0.1 may provide a higher locking strength. The preferred ratio can depend on e.g. the material of the locking strip.

An aspect of the first panel 1 is shown in FIGS. 6B-6C, 7B and 8B, where the second panel surface 13 comprising the flexing groove 8 is shown.

As shown for example in FIGS. 6B, 6C, 7B and 8B, the first panel 1 may have a third edge 14 and a fourth edge 15, the third edge 14 being at a distance TL from the fourth edge 15.

The flexing groove 8 may have a length L, which in one aspect may extend from the third edge 14 to the fourth edge 15.

The flexing groove 8 may have a fifth 82 edge and a sixth 83 edge, where the fifth edge 82 may be positioned at a distance X from the third 14 edge and the sixth edge 83 may be positioned at a distance X from the fourth edge 15. The distance X may be within the range of about 5 mm to about 30 mm, preferably about 10 mm to about 20 mm, more preferably about 15 mm.

Figure 7A:
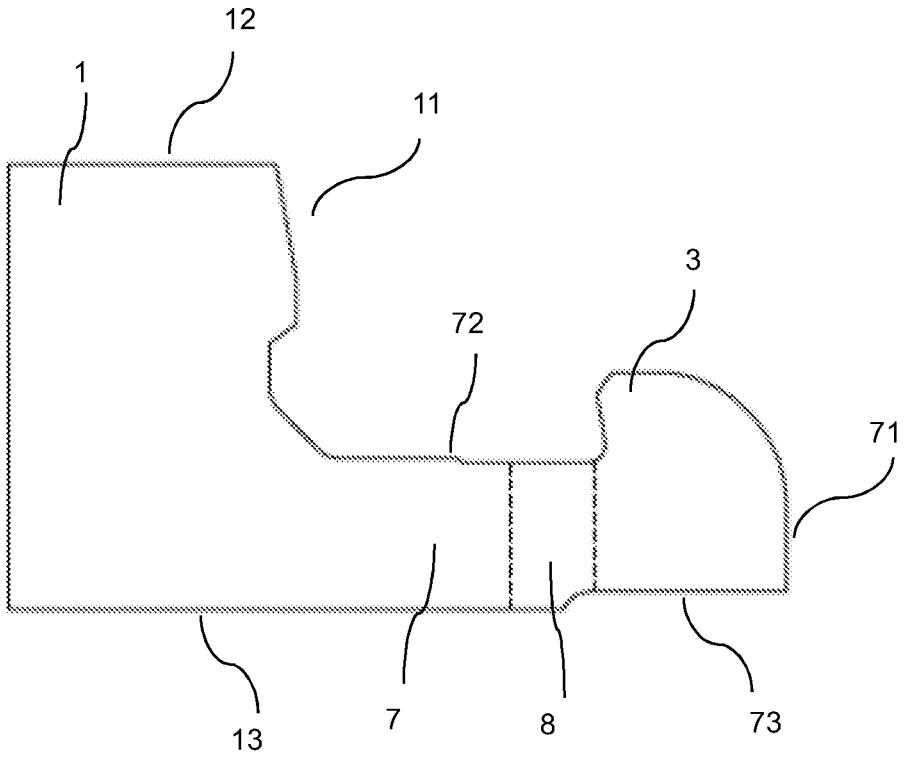
FIGS. 7A-7B show an illustrative first panel comprising a locking strip and a flexing groove, which extends throughout the whole distance from the second locking strip surface to the first locking strip surface. According to this aspect, the flexing groove does not extend over the whole length of the first panel, but extends a distance X from the third edge of the first panel to a distance X from the fourth edge of the first panel.
Figure 7B:
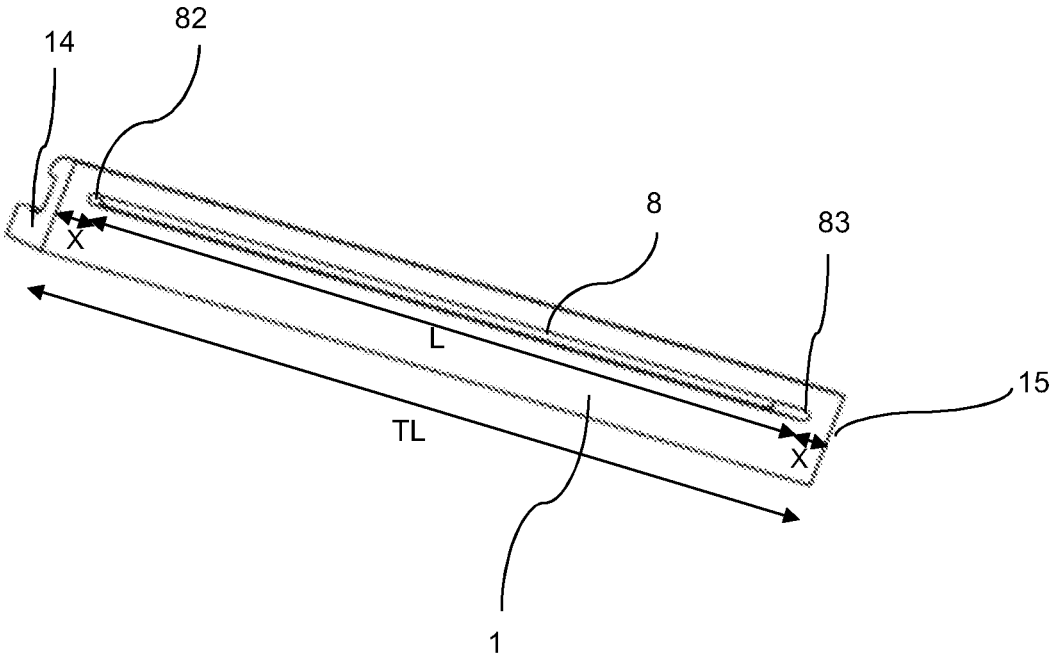

In one aspect shown in FIGS. 7A-7B, the flexing groove 8 extends throughout the whole distance from the second locking strip surface 73 to the first locking strip surface 72. According to this aspect, the flexing groove 8 does not extend over the whole distance TL of the first panel 1, but extends a distance X from the third edge 14 of the first panel 1 to a distance X from the fourth edge 15 of the first panel 1.

Figure 8A:
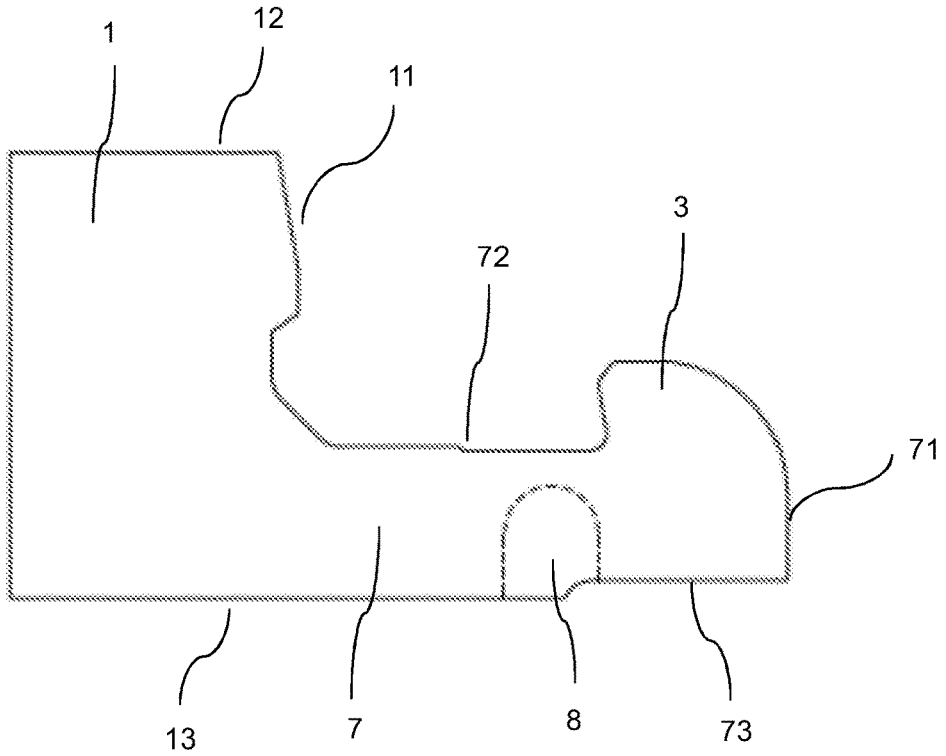
FIGS. 8A-8B show an illustrative embodiment of a first panel comprising a locking strip and a flexing groove, where the flexing groove may extend throughout the whole distance from the second locking strip surface to the first locking strip surface, but does not extend the whole length of the first panel. According to this aspect, the flexing groove is not continuous, but is divided into two or more grooves running in line with a space between them. A first flexing groove extends a distance X from the third edge of the first panel and a last flexing groove extends a distance X from the fourth edge of the first panel.
Figure 8B:
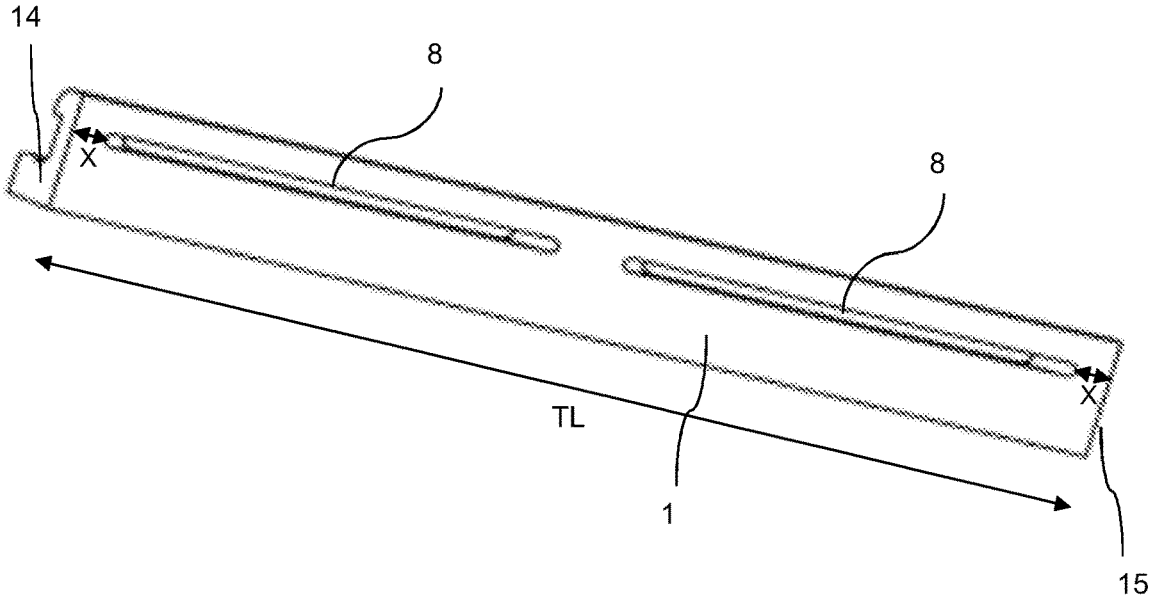

In one aspect shown in FIGS. 8A-8B, the flexing groove 8 does not extend throughout the whole distance from the second locking strip surface 73 to the first locking strip surface 72. According to this aspect, the flexing groove 8 does not extend the whole distance TL of the first panel 1. Further, the groove 8 does not have to be continuous, but may divided into two or more flexing grooves 8 running in line with a space between them.

In one aspect a first flexing groove 8, the flexing groove 8 closest to the third edge 14, may extend a distance X from the third edge 14 of the first panel 1, and another flexing groove 8, being the flexing groove 8 closest to the fourth edge 15, extends a distance X from the fourth edge 15 of the first panel 1. Thus, according to this aspect there is not only one flexing groove 8 on the first panel 1, but two or more flexing grooves 8, preferably on an essentially straight line parallel with the locking strip edge 71. The two or more flexing grooves 8 are preferably separated a distance of 5 mm to 30 mm.

In one aspect the bottom 81 of the flexing groove 8 may be essentially arch shaped.

In one aspect the bottom 81 of the flexing groove 8 may be essentially triangular.

In one aspect the cross-sectional shape of the flexing groove 8 is essentially rectangular or square.

The first or second direction for locking of the first panel 1 to the second panel 2 may be parallel and/or perpendicular to the first panel surface 12.

In one aspect the flexing groove 8 is positioned at a distance Y from the first edge 11.

According to an aspect, the distance Y is to be measured between the flexing groove 8 and the intersection between the first edge 11 and the first panel surface 12.

A ratio between the distance Y and the distance Q may be within the range of about 0 to about 0.5, preferably about 0.1 to about 0.3. The values are low enough to allow an easy assembling and high enough to allow a sufficient locking strength. A ratio of e.g. 0.1 may provide an easier assembling and a ratio of e.g. 0.5 may provide a higher locking strength. The preferred ratio can depend on e.g. the material of the locking strip.

In one aspect the distance between the flexing groove 8 and the locking element 3 is shorter than the distance between the flexing groove 8 and the first edge 11.

The core of the first panel 1 and/or of the second panel 2 may be a wood-based core, preferably made of MDF, HDF, OSB, WPC, plywood or particleboard. The core may also be a plastic core comprising thermosetting plastic or thermoplastic e.g., vinyl, PVC, PU or PET. The plastic core may comprise fillers. The core may also be mineral based board which may comprise e.g., MgO.

The first panel 1 and/or the second panel 2 may also be of solid wood.

The locking strip 7 may comprises a material of a core of the first panel.

The flexing groove 8 and the recess 74 may be formed in the material of the core of the first panel.

The mechanical locking device may be partly or completely formed in a core material of the first panel and the second panel.

The first panel 1 and/or the second panel 2 may be provided with a decorative layer, such as a foil or a veneer, on one or more surfaces.

Figure 4A:
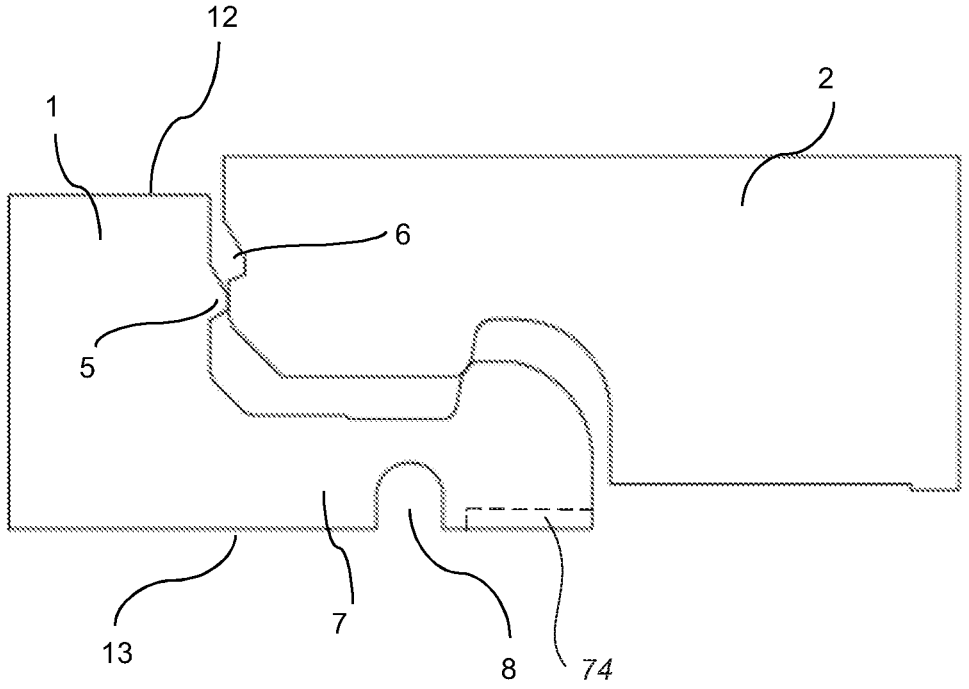
FIG. 4A shows a side view of an illustrative set in an unassembled state, wherein the first edge of the first panel comprises a tongue configured to cooperate with a tongue groove at the second edge of the second panel.
Figure 4B:
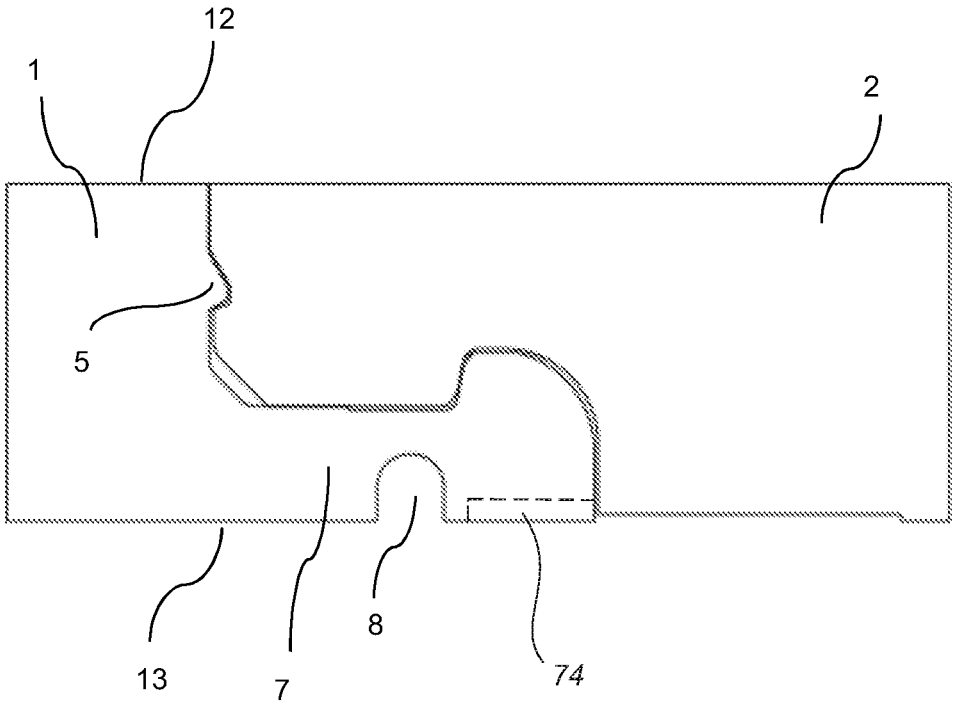
FIG. 4B shows a side view of an illustrative set in an assembled state, wherein the first edge of the first panel comprises a tongue configured to cooperate with a tongue groove at the second edge of the second panel.

In one aspect, as shown in FIGS. 4A-4B, the first edge 11 of the first panel 1 comprises a tongue 5 and the second edge 21 of the second panel 2, opposite to the first edge 11 of the first panel 1, comprises a tongue groove 6. The tongue 5 on the first edge 11 is configured to cooperate with the tongue groove 6 on the second edge 21 for locking in a vertical direction. The second locking strip surface 73 may comprise a recess 74 which extends from the locking strip edge 71 towards the flexing groove 8. FIG. 4A shows the first and second panels 1, 2 according to this aspect in an unassembled state, while FIG. 4B shows the first and second panels 1, 2 according to this aspect in an assembled state.

Figure 5A:
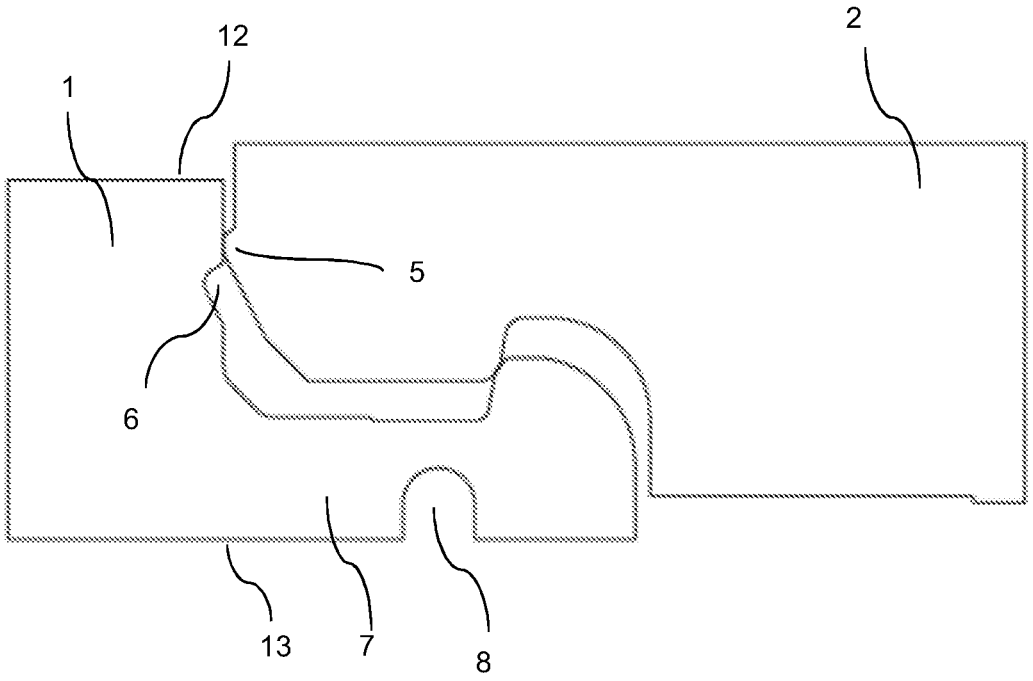
FIG. 5A shows a side view of an illustrative set in an unassembled state, wherein the second edge of the second panel comprises a tongue configured to cooperate with a tongue groove at the first edge of the first panel.
Figure 5B:
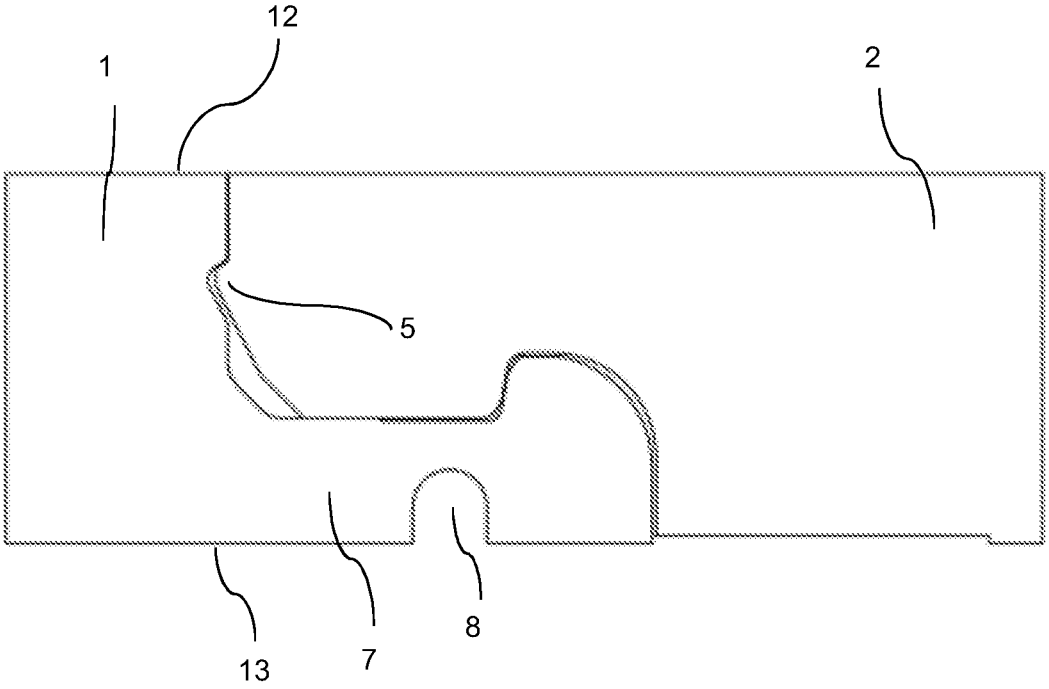
FIG. 5B shows a side view of an illustrative set in an assembled state, wherein the second edge of the second panel comprises a tongue configured to cooperate with a tongue groove at the first edge of the first panel.
Figure 6A:
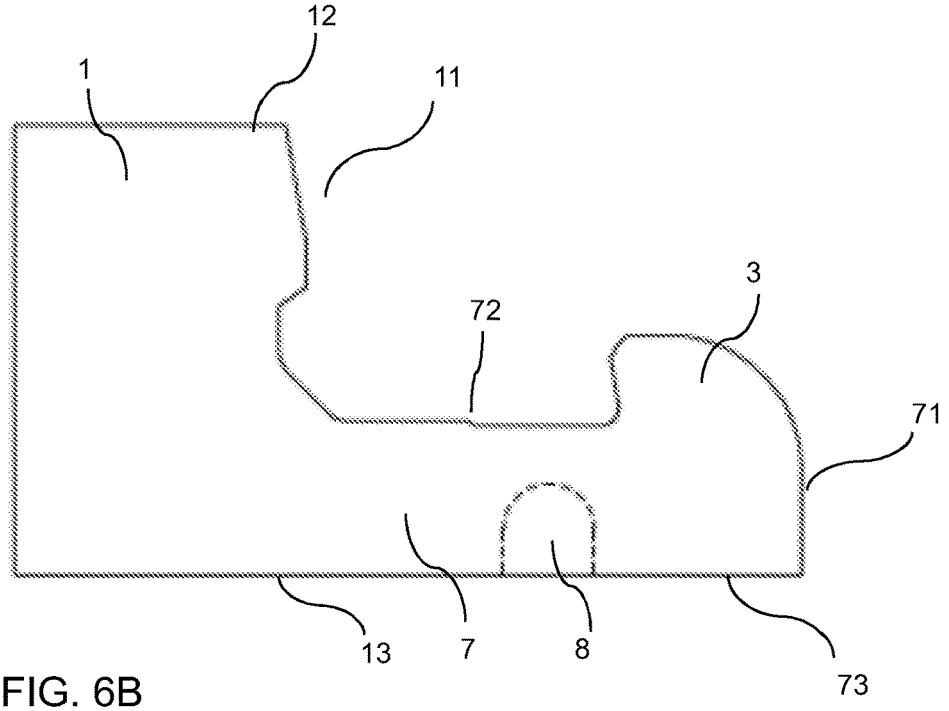
FIG. 6A shows a side view of an illustrative first panel comprising a locking strip and a flexing groove, which does not extend the whole length of the first panel, but which extends a distance X from the third edge of the first panel to a distance X from the fourth edge of the first panel.
Figure 6B:
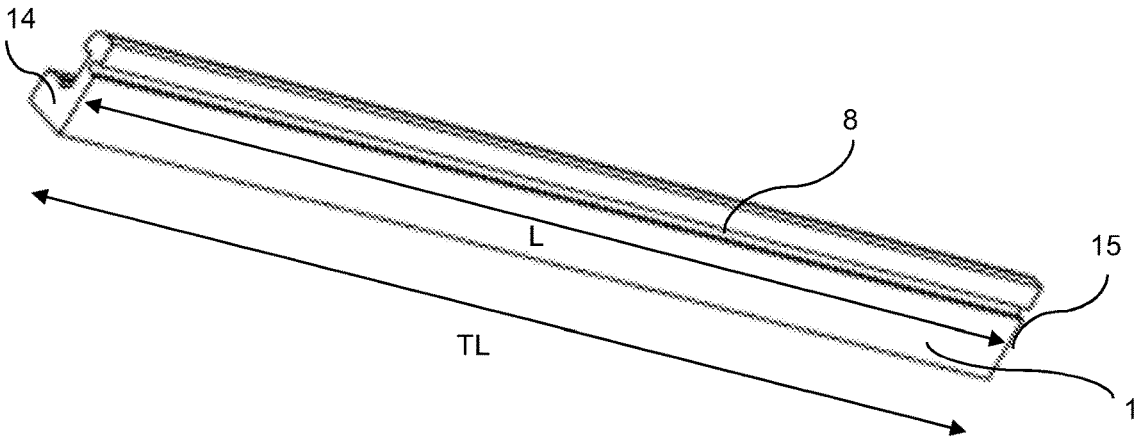
FIG. 6B shows a view of an illustrative first panel comprising a locking strip and a flexing groove, which extends over the whole length of the first panel.
Figure 6C:
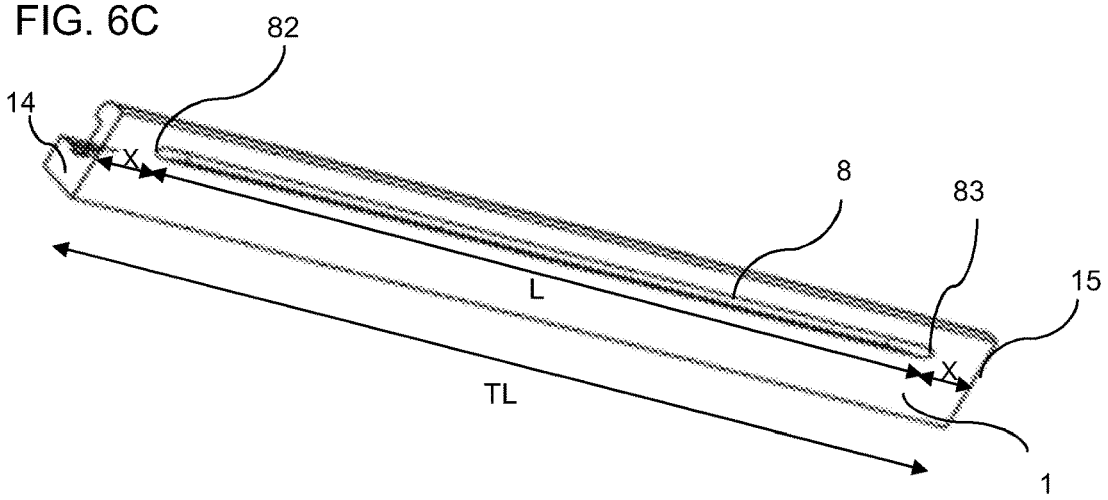
FIG. 6C shows a view of an illustrative first panel comprising a locking strip and a flexing groove, which does not extend over the whole length of the first panel, but which extends a distance X from the third edge of the first panel to a distance X from the fourth edge of the first panel.

In one aspect, as shown in FIGS. 5A-5B, the second edge 21 of the second panel 2 comprises a tongue 5 and first edge 11 of the first panel 1, opposite to the second edge 21 of the second panel 2, comprises a tongue groove 6. The tongue 5 on the second edge 21 is configured to cooperate with the tongue groove 6 on the first edge 11 for locking in a vertical direction. FIG. 5A shows the first and second panels 1, 2 according to this aspect in an unassembled state, while FIG. 5B shows the first and second panels 1, 2 according to this aspect in an assembled state.

Figure 9:
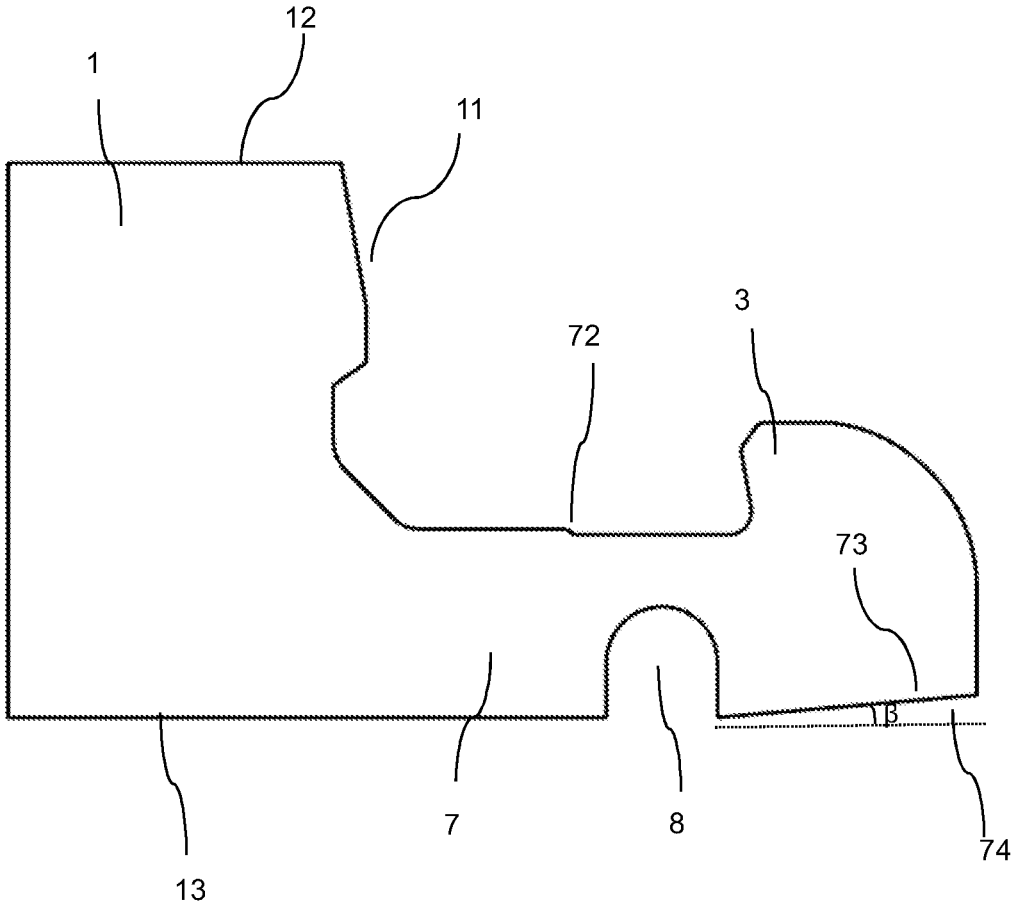
FIG. 9 shows a side view of an illustrative first panel. The first panel comprises a locking strip, a flexing groove and a recess, where the second locking strip surface and thus the recess, do not run parallel to the second panel surface, but at an angle β from the second panel surface.

In one aspect, as shown FIG. 9, the first panel comprises a locking strip, a flexing groove and a recess, wherein the second locking strip surface 73 (and thus the recess) do not run parallel to the second panel surface 13, but at an angle β from the second panel surface 13. The angle β may be in the range of about 0 to about 45°, or in the range of about 0 to about 20°, or in the range of about 0 to about 10°, or about 5°.

The first panel 1 and the second panel 2 may be of a rectangular shape.

The first panel 1 may comprise an edge opposite the first edge which is essentially identical to the second edge of the second panel 2.

The second panel 2 may comprise an edge opposite the second edge which is essentially identical to the first edge of the first panel 1.

The first edge and the second edge may be short edges of the first panel and the second panel.

The assembling may also comprise an angling motion along a long side of the first panel and/or the second panel.

Further embodiments of the invention are described below:

1. A set of panels comprising a first panel (1), a second panel (2) and a mechanical locking device for locking the first panel (1) to the second panel (2), the mechanical locking device being configured for an assembly by a displacement of the second panel (2) in relation to the first panel (1) in a vertical direction to obtain a locked position of the first panel (1) and the second panel (2), wherein the first panel (1) comprises a first edge (11), a first panel surface (12) and a second panel surface (13), and the second panel (2) comprises a second edge (21), wherein the mechanical locking device comprises a locking strip (7) extending from the first edge (11) in a direction parallel to the first and second panel surfaces (12, 13), wherein the locking strip (7) comprises a locking strip edge (71), wherein the locking strip (7) comprises a first locking strip surface (72) extending in a direction substantially corresponding to the direction of the first panel surface (12) of the first panel (1), wherein the locking strip (7) comprises a second locking strip surface (73) extending in a direction substantially corresponding to the direction of the second panel surface (13) of the first panel (1), wherein the locking strip (7) comprises a locking element (3) configured to cooperate with a locking groove (4) at the second edge (21) of the second panel (2) for locking in a direction parallel to the first panel surface (12), wherein one of the first or second edge (11, 21) comprises a tongue (5) configured to cooperate with a tongue groove (6) at the other one of the first or second edge (11, 21) for locking in a vertical direction, and wherein the locking strip (7) comprises a flexing groove (8) extending from the second locking strip surface (73) into the locking strip (7), and wherein the locking strip (7) is configured to flex by varying a shape of the flexing groove (8) during the assembly, thereby increasing a flexibility of the locking strip (7) during the assembly.

2. The set of panels as described in embodiment 1, wherein the second locking strip surface (73) comprises a recess (74) extending from the locking strip edge (71) towards the flexing groove (8) and parallel to the second panel surface (13).

3. The set of panels as described in any one of the previous embodiments, wherein the recess (74) has a length B and wherein locking strip edge (71) is positioned at a distance Q from the first edge (11).

4. The set of panels as described in embodiment 3, wherein a ratio between the length B of the recess (74) and the distance Q is within the range of about 0.1 to about 0.9, preferably about 0.2 to about 0.6, more preferably about 0.35.

5. The set of panels as described in any one of embodiments 2 to 4, wherein the recess (74) has a height A within the range of about 0.10 mm to about 0.50 mm, preferably about 0.15 mm to about 0.40 mm, more preferably about 0.20 mm to about 0.30 mm.

6. The set of panels as described in any one of the previous embodiments, wherein an opening of the flexing groove (8) has a width T.

7. The set of panels as described in embodiment 6, wherein the width T of the opening of the flexing groove (8) is within the range of about 1 mm to about 10 mm, preferably about 1.2 mm to about 2.5 mm, more preferably about 1.5 mm.

8. The set of panels as described in any one of the previous embodiments, wherein a distance D between the bottom (81) of the flexing groove (8) and the first locking strip surface (72) is within the range of about 0.5 mm to about 5 mm, preferably about 1 mm to about 2.5 mm, more preferably about 1.5 mm.

9. The set of panels as described in any one of the previous embodiments, wherein the flexing groove (8) extends at an angle $\alpha$ from the second panel surface (13).

10. The set of panels as described in embodiment 9, wherein the angle $\alpha$ is within the range of about 30° to about 100°, preferably about 60° to about 80°, more preferably about 70°.

11. The set of panels as described in any one of the previous embodiments, wherein the flexing groove (8) is positioned at a distance Z from the locking strip edge (71) of the locking strip (7).

12. The set of panels as described in embodiment 11, wherein a ratio between the distance Z and the distance Q is within the range of about 0 to about 0.5, preferably about 0.1 to about 0.3.

13. The set of panels as described in any one of the previous embodiments, wherein the flexing groove (8) has a length L.

14. The set of panels as described in any one of the previous embodiments, wherein the first panel (1) comprises a third edge (14) and a fourth edge (15), the third edge (14) being at a distance TL from the fourth edge (15).

15. The set of panels as described in embodiment 14, wherein the length L of the flexing groove (8) extends from the third edge (14) of the first panel (1) to the fourth edge (15) of the first panel (1).

16. The set of panels as described in any one of embodiments 1 to 14, wherein the flexing groove (8) has a fifth (82) edge and a sixth (83) edge, the fifth edge (82) being positioned at a distance X from the third (14) edge and the sixth edge (83) being positioned at a distance X from the fourth edge (15).

17. The set of panels as described in embodiment 16, wherein the distance X is within the range of about 5 mm to about 30 mm, preferably about 10 mm to about 20 mm, more preferably about 15 mm.

18. The set of panels as described in any one of the previous embodiments, wherein a bottom (81) of the flexing groove (8) is essentially arch shaped.

19. The set of panels as described in any one of embodiments 1 to 17, wherein a bottom (81) of the flexing groove (8) is essentially triangular.

20. The set of panels as described in any one of embodiments 1 to 17, wherein a cross-sectional shape of the flexing groove (8) is essentially rectangular or square.

21. The set of panels as described in any one of the previous embodiments, wherein the mechanical locking device is configured to lock the first panel 1 and the second panel 2 in a first direction parallel to the first panel surface 12 and/or in a second direction perpendicular to the first panel surface 12.

22. The set of panels as described in any one of the previous embodiments, wherein the flexing groove (8) is positioned at a distance Y from the first edge (11).

23. The set of panels as described in embodiment 22, wherein a ratio between the distance Y and the distance Q is within the range of about 0 to about 0.5, preferably about 0.1 to about 0.3.

24. The set of panels as described in any one of the previous embodiments, wherein a distance between the flexing groove (8) and the locking element (3) is shorter than a distance between the flexing groove (8) and the first edge (11).

25. The set of panels as claimed in any one of the previous embodiments, wherein the second locking strip (7) comprises a material of a core of the first panel, and wherein the flexing groove (8) and the recess (74) are formed in the material of the core of the first panel (1).

The invention claimed is:

1. A set of panels comprising a first panel, a second panel and a mechanical locking device for locking the first panel to the second panel, the mechanical locking device being configured for an assembly by a displacement of the second panel in relation to the first panel in a vertical direction to obtain a locked position of the first panel and the second panel, wherein the first panel comprises a first edge, a first panel surface and a second panel surface, and the second panel comprises a second edge, wherein the mechanical locking device comprises a locking strip extending from the first edge in a direction parallel to the first and second panel surfaces, wherein the locking strip comprises a locking strip edge, wherein the locking strip comprises a first locking strip surface extending in a direction substantially corresponding to the direction of the first panel surface of the first panel, wherein the locking strip comprises a second locking strip surface extending, from a point vertically aligned with the first edge, in a direction substantially corresponding to the direction of the second panel surface of the first panel, wherein the locking strip comprises a locking element configured to cooperate with a locking groove at the second edge of the second panel for locking in a direction parallel to the first panel surface, wherein one of the first or second edge comprises a tongue configured to cooperate with a tongue groove at the other one of the first or second edge for locking in a vertical direction, wherein the locking strip comprises a flexing groove extending from the second locking strip surface into the locking strip, and the locking strip is configured to flex by varying a shape of the flexing groove during the assembly, wherein the second locking strip surface comprises a recess extending from the locking strip edge towards the flexing groove and parallel to the second panel surface in a relaxed state of the locking strip, wherein the second locking strip surface is free of a separate recess between the first edge and the flexing groove, and the flexing groove is spaced from the entirety of the recess, and wherein the recess extends over at least half of a distance between the flexing groove and the locking strip edge.

2. The set of panels as claimed in claim 1, wherein a distance D between a bottom of the flexing groove and the first locking strip surface is within the range of about 0.5 mm to about 5 mm.

3. The set of panels as claimed in claim 1, wherein the first panel comprises a third edge and a fourth edge, the third edge being at a distance TL from the fourth edge.

4. The set of panels as claimed in claim 1, wherein the flexing groove has a length L, and wherein the length L of the flexing groove extends from the third edge of the first panel to the fourth edge of the first panel.

5. The set of panels as claimed in claim 1, wherein a bottom of the flexing groove is essentially arch shaped.

6. The set of panels as claimed in claim 1, wherein a bottom of the flexing groove is essentially triangular.

7. The set of panels as claimed in claim 1, wherein a cross-sectional shape of the flexing groove is essentially rectangular or square.

8. The set of panels as claimed in claim 1, wherein the mechanical locking device is configured to lock the first panel and the second panel in a first direction parallel to the first panel surface and/or in a second direction perpendicular to the first panel surface.

9. The set of panels as claimed in claim 1, wherein the flexing groove has only a single opening.

10. The set of panels as claimed in claim 1, wherein the second locking strip comprises a material of a core of the first panel, and wherein the flexing groove and the recess are formed in the material of the core of the first panel.

11. The set of panels as claimed in claim 10, wherein the recess has a height A within the range of about 0.10 mm to about 0.50 mm.

12. The set of panels as claimed in claim 1, wherein an opening of the flexing groove has a width T, wherein the width T of the opening of the flexing groove is within the range of about 1 mm to about 10 mm.

13. The set of panels as claimed in claim 12, wherein the width T of the opening of the flexing groove is within the range of about 1.2 mm to about 2.5 mm.

14. The set of panels as claimed in claim 1, wherein at least one inner surface of the flexing groove extends at an angle $\alpha$ from the second panel surface, wherein the angle $\alpha$ is within the range of about 30° to about 100°.

15. The set of panels as claimed in claim 14, wherein the angle $\alpha$ is within the range of about 60° to about 80°.

16. The set of panels as claimed in claim 1, wherein the flexing groove has a fifth edge and a sixth edge, the fifth edge being positioned at a distance X from the third edge and the sixth edge being positioned at a distance X from the fourth edge.

17. The set of panels as claimed in claim 16, wherein the distance X is within the range of about 5 mm to about 30 mm.

18. The set of panels as claimed in claim 1, wherein the flexing groove is positioned at a distance Y from the first edge, wherein a ratio between the distance Y and the distance Q is within the range of about 0 to about 0.5.

19. The set of panels as claimed in claim 18, wherein a ratio between the distance Y and the distance Q is within the range of about 0.1 to about 0.3.

20. A set of panels comprising a first panel, a second panel and a mechanical locking device for locking the first panel to the second panel, the mechanical locking device being configured for an assembly by a displacement of the second panel in relation to the first panel in a vertical direction to obtain a locked position of the first panel and the second panel, wherein the first panel comprises a first edge, a first panel surface and a second panel surface, and the second panel comprises a second edge, wherein the mechanical locking device comprises a locking strip extending from the first edge in a direction parallel to the first and second panel surfaces, wherein the locking strip comprises a locking strip edge, wherein the locking strip comprises a first locking strip surface extending in a direction substantially corresponding to the direction of the first panel surface of the first panel, wherein the locking strip comprises a second locking strip surface extending, from a point vertically aligned with the first edge, in a direction substantially corresponding to the direction of the second panel surface of the first panel, wherein the locking strip comprises a locking element configured to cooperate with a locking groove at the second edge of the second panel for locking in a direction parallel to the first panel surface, wherein one of the first or second edge comprises a tongue configured to cooperate with a tongue groove at the other one of the first or second edge for locking in a vertical direction, wherein the locking strip comprises a flexing groove extending from the second locking strip surface into the locking strip, and the locking strip is configured to flex by varying a shape of the flexing groove during the assembly, wherein the second locking strip surface comprises a recess extending from the locking strip edge towards the flexing groove and parallel to the second panel surface in a relaxed state of the locking strip, wherein the second locking strip surface is free of a separate recess between the first edge and the flexing groove, and wherein the recess has a length B and wherein locking strip edge is positioned at a distance Q from the first edge, and a ratio between the length B of the recess and the distance Q is within the range of about 0.1 to about 0.9.

21. The set of panels as claimed in claim 20, wherein a ratio between the length B of the recess and the distance Q is within the range of about 0.2 to about 0.6.

22. The set of panels as claimed in claim 20, wherein the flexing groove is positioned at a distance Z from the locking strip edge of the locking strip, and a ratio between the distance Z and the distance Q is within the range of about 0 to about 0.5.

23. The set of panels as claimed in claim 22, wherein a ratio between the distance Z and the distance Q is within the range of about 0.1 to about 0.3.

24. A set of panels comprising a first panel, a second panel and a mechanical locking device for locking the first panel to the second panel, the mechanical locking device being configured for an assembly by a displacement of the second panel in relation to the first panel in a vertical direction to obtain a locked position of the first panel and the second panel, wherein the first panel comprises a first edge, a first panel surface and a second panel surface, and the second panel comprises a second edge, wherein the mechanical locking device comprises a locking strip extending from the first edge in a direction parallel to the first and second panel surfaces, wherein the locking strip comprises a locking strip edge, wherein the locking strip comprises a first locking strip surface extending in a direction substantially corresponding to the direction of the first panel surface of the first panel, wherein the locking strip comprises a second locking strip surface extending, from a point vertically aligned with the first edge, in a direction substantially corresponding to the direction of the second panel surface of the first panel, wherein the locking strip comprises a locking element configured to cooperate with a locking groove at the second edge of the second panel for locking in a direction parallel to the first panel surface, wherein one of the first or second edge comprises a tongue configured to cooperate with a tongue groove at the other one of the first or second edge for locking in a vertical direction, wherein the locking strip comprises a flexing groove extending from the second locking strip surface into the locking strip, and the locking strip is configured to flex by varying a shape of the flexing groove during the assembly, wherein the second locking strip surface comprises a recess extending from the locking strip edge towards the flexing groove and parallel to the second panel surface in a relaxed state of the locking strip, wherein the second locking strip surface is free of a separate recess between the first edge and the flexing groove, and wherein a distance between the flexing groove and the locking element is shorter than a distance between the flexing groove and the first edge.

* * * * *